US005482217A

United States Patent [19]

Schonert et al.

[11] Patent Number: 5,482,217

[45] Date of Patent: Jan. 9, 1996

[54] METHOD OF AND APPARATUS FOR FINE, VERY FINE, AND MICROFINE COMMINUTION OF MATERIALS HAVING BRITTLE BEHAVIOR

[75] Inventors: Klaus Schonert; York Reichardt, both of Clausthal-Zellerfeld, Germany

[73] Assignee: Klaus Schönert, Clausthal-Zellerfeld, Germany

[21] Appl. No.: 140,112

[22] PCT Filed: May 4, 1992

[86] PCT No.: PCT/EP92/00962

§ 371 Date: Jun. 15, 1994

§ 102(e) Date: Jun. 15, 1994

[87] PCT Pub. No.: WO92/19379

PCT Pub. Date: Nov. 12, 1992

[30] Foreign Application Priority Data

May 3, 1991 [DE] Germany ..... 41 14 521.6

[51] Int. Cl.[6] ..... B02C 19/00; B02C 23/08; B02C 9/04

[52] U.S. Cl. ..... 241/24; 241/27; 241/29; 241/164; 241/263; 241/283

[58] Field of Search ..... 241/24, 27, 29, 241/283, 164, 165, 263

[56] References Cited

U.S. PATENT DOCUMENTS

| | | | |
|---|---|---|---|
| 695,076 | 3/1902 | Ohm | 241/165 X |
| 779,205 | 1/1905 | Campbell | 241/283 |
| 1,715,724 | 6/1929 | Thompson | 241/165 |
| 3,802,629 | 4/1974 | Flanagan | 241/283 X |
| 4,357,287 | 11/1982 | Schonert . | |
| 4,449,671 | 5/1984 | Martinez-Verh et al. | 241/283 X |

FOREIGN PATENT DOCUMENTS

| | | | |
|---|---|---|---|
| 2062252 | 7/1971 | Germany | 241/263 |
| 2753920 | 6/1978 | Germany . | |
| 47-984 | 1/1972 | Japan | 241/283 |
| 854438 | 8/1981 | U.S.S.R. | 241/283 |
| 1072883 | 2/1984 | U.S.S.R. | 241/283 |
| 1733075 | 5/1992 | U.S.S.R. | 241/263 |

*Primary Examiner*—Timothy V. Eley
*Attorney, Agent, or Firm*—Kenyon & Kenyon

[57] ABSTRACT

Brittle material (1) is ground batchwise as a bed of particles by compression between non-yielding hard surfaces at a pressure of at least 50 MPa. In order to reduce the energy requirement and machine expenditure needed for fine, superfine and microfine comminution, the bed of particles is subjected to repeated stressing by pistons (4) in different directions and at least in part successively. The stressing preferably is accomplished by groups of two opposed pistons (4), which are offset at an angle with respect to each other and which are rendered active one after the other. The stressing is repeated in another plane of the grinding chamber. Wet grinding is carried out in a closed grinding chamber from which the liquid expelled from the voids between the particles being ground can drain through at least one aperture of narrow cross section.

15 Claims, 4 Drawing Sheets

Fig. 1a
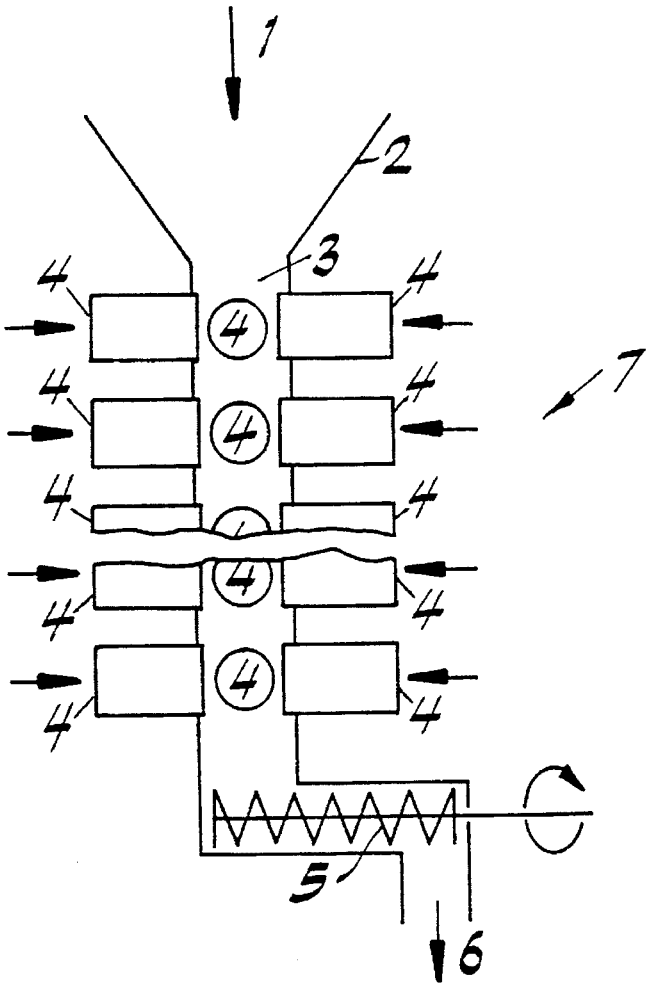
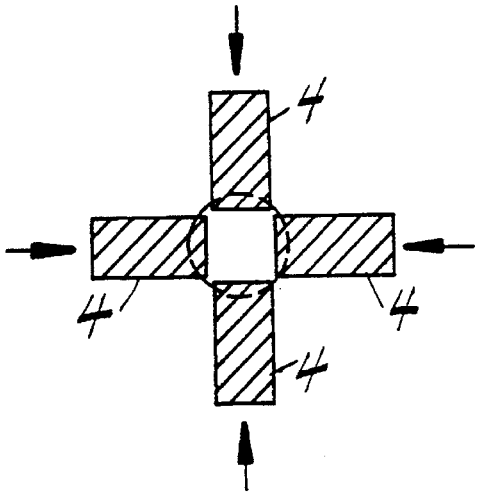
Fig. 1b

METHOD OF AND APPARATUS FOR FINE, VERY FINE, AND MICROFINE COMMINUTION OF MATERIALS HAVING BRITTLE BEHAVIOR

BACKGROUND OF THE INVENTION

Fine, very fine, and microfine comminution of brittle materials to obtain products having maximum particle sizes of between 100 and 300 μm (fine comminution) or between 10 and 50 μm (very fine comminution) or between 1 and 5 μm (microfine comminution) usually is accomplished by means of ball mills, vibration mills, planetary mills, agitator mills, and high-pressure roller mills. Until the beginning of the century also stamp mills were used for fine comminution of mineral raw materials. Ball mills, vibration mills, and planetary mills are used both for dry and wet milling, while agitator mills and stamp mills are used almost exclusively for wet milling, and high-pressure roller mills for grinding dry and wet material. As a rule, a mill is combined with a classifier to provide for grinding in a circuit, with the ground product being fed to the classifier where it is divided into fine material and coarse material, the latter being recirculated to the mill for renewed grinding. Ball mills, vibration mills, planetary mills, agitator mills, and especially the known stamp mills have a low degree of efficiency so that the specific energy consumption (the energy requirement based on the mill product obtained by comminution) is very high. Energy consumption for fine comminution (100 to 300 μm) ranges from 10 to 40 kWh/t, it is from 50 to 150 kWh/t for very fine comminution (10 to 50 μm) and above 500 kWh/t for microfine comminution (1 to 5 mm). In addition, the mechanical expenditure is high. A substance exhibits brittle behavior if, prior to beginning to crack, a solid particle of it is deformed largely elastically.

It is true, high-pressure roller mills (U.S. Pat. No. 4,357,287) operating with a pressure in the roller nip of at least 50 MPa require little energy, but the yield in terms of very fine product and especially microfine product at pressures which still can be mastered on an industrial scale is relatively low. This results in a high ratio of coarse material recirculated which in turn requires greater structural units as far as mills, classifiers, and conveyor means are concerned, all involving high capital investment. In the case of nigh-pressure roller mills there is an additional difficulty in the case of microfine grinding in that the material to be ground is poorly drawn into the nip between rollers. The peripheral speed of the rollers, therefore, must be reduced and, possibly, the introduction of material into the nip be supported by feed worms in a feed funnel.

It is an advantage of ball mills and stamp mills that the feeding of the material to be ground into the grinding chamber causes no problems and that they are suitable for wet grinding. They are only little affected by foreign matter and, in principle, sturdier than many other comminuting machines. Parts subject to wear are of simple shape and can be exchanged with ease. Stamp mills have a disadvantage in that the throughput per stamp unit is low.

The one-time stressing of material to be ground in a ram press (U.S. Pat. No. 4,357,287) also requires a high circulation ratio and considerable expenditure for machinery. Following compression in the ram press, the compacted material can be loosened first by mechanical action exerted by corresponding tools which rearrange the material if it is to be stressed once again afterwards by compression before being conveyed out of the grinding chamber for disagglomeration of the resulting agglomerates (briquettes).

SUMMARY OF THE INVENTION

It is the object of the invention to provide a method and an apparatus by which fine, very fine, and microfine comminution of brittle materials can be performed with operational safety by dry or wet procedures at relatively low energy and mechanical expenditure.

This object is met, in accordance with the invention, by a method of fine, very fine, and microfine comminution of brittle materials, wherein material to be ground in the form of a bed of material, is compressed repeatedly by pistons between two hard, non-yielding surfaces in a grinding chamber and stressed or compressed, respectively, at a pressure of at least 50 MPa, and agglomerates formed are disagglomerated in a succeeding stage subsequent to the last stressing, and any coarse particles separated by classification, if desired, are subjected to further stressing. For very fine comminution, the material to be ground should be stressed at a pressure of at least 150 MPa. For microfine comminution of the material to be ground a pressure of at least 250 MPa proved to be successful. The pressure in this case is set at such a high value above 50 MPa that it will be especially favorable for the specific material to be ground, the specific average particle size of the material to be ground which is introduced between the surfaces, and the specific degree of comminution by stressing. The number of stressing operations performed on the material to be ground in the grinding chamber is selected in the same way.

The successive stressings of the material to be ground by the pistons preferably take place offset by from 60° to 120°, especially 90° with respect to each other Wet grinding is effected in a grinding chamber which is closed toward the outside and from which the liquid or air expelled from the voids between the particles of the material being ground can escape through at least one aperture of narrow cross section.

This is opposed to the known wet grinding and sieving apparatus as described in DE-A 27 53 920 for processing multi-phase materials under high pressure. Such materials include a solid phase and a liquid or viscous phase. Yielding and soft materials envisaged for such processing include household waste, parts of plants, slurry-like waste, bones, vegetables, organic substances, meat, meat emulsions etc.. Grinding and sieving is carried out simultaneously in a closed grinding chamber into which at least one piston or plunger is pushed while at the same time ground material is expelled as product through calibrated openings of the grinding chamber. These openings may have the form of round, semi-circular or square grooves or channels with a depth of 2 to 30 mm. Household waste may be subjected to pressures between 300 and 2000 kg/cm$^2$ (30 and 200 MPa). This type of combined grinding and sieving (classifying) is not suitable for the fine and microfine grinding of brittle materials because the very difficulty of ensuring that the particles do not escape the zone of stressing is not overcome.

The method of the invention differs from the methods applied so far in that the material which is to be comminuted is stressed several times in the form of a bed of material between two hard, non-yielding surfaces by a plurality of pistons acting from different directions.

A comminution apparatus suitable to carry out this method comprises at least one grinding chamber to be loaded and unloaded in batches with material to be ground and having hard non-yielding surfaces and further comprises grinding pistons which are adapted to be pushed forward into the grinding chamber and which stress the material to be ground from different directions and in succession, pressing it against hard surfaces. The hard surfaces can be formed by further pistons, and the pistons are combined in groups in one plane or in different planes and act against each other. Opposed pistons of a pair of pistons can be moved against each other thereby stressing the bed of particles in the same direction. The pistons of two adjacent planes may be arranged offset at an angle of from 60 to 120°, preferably 90° with respect to each other. The opposed pistons of a pair of pistons are moved against each other simultaneously. The other pairs of pistons each stress the material to be ground one after the other.

For wet grinding, the grinding chamber is closed all around and the liquid or air expelled from the voids between particles of the material being ground due to the stressing thereof can escape from the same through at least one aperture of narrow cross section, in particular through a gap between the piston and the piston channel wall into the feeding chute. At least one piston is designed as loading piston and one piston as unloading piston having an increased backward stroke as compared to normal grinding pistons.

The multiple stressing of the material to be ground in a bed of material which is compressed several times in the same direction without rebedding realized in stamp mills or conventional ram presses, brings no noticeable progress in comminution from the second stressing on because the first stressing already produces a state which is at equilibrium with the prevailing pressure. It is only if the bed of material is loosened between two successive acts of stressing and the particles are rearranged into a new mutual orientation that the subsequent stressing can afford further noticeable pronoticeable progress in comminution. Such procedures and the corresponding equipment are known. They do require additional intervention in the compacted bed of material between successive stressing operations involving corresponding additional mechanical expenditure, as was previously realized with a ram press. The invention avoids this disadvantage by effecting successive stressings in different directions which preferably are offset with respect to each other by from 60° to 120°. The stressing is repeated several times, yet only until the production of further fine material per stressing operation reduces noticeably. The fine comminution of a few hard substances requires but relatively low compaction at between 50 and 120 MPa and only a few stressing operations; usually from 2 to 5 will be sufficient. Very fine comminution requires higher compression and a greater number of compressions, usually at least 5 such actions at preferably at least 150 MPa. Microfine comminution of very hard substances having a hardness on the Mohs scale of more than 7, on the other hand, requires higher pressures, preferably more than 250 MPa and a greater number of stressing events. The number thereof may be ten or more, depending on the material to be ground and on the desired fineness. The production of fine and very fine and microfine products can be increased manifold by the successive stressing operations from different directions according to the invention, and yet the specific energy requirement does not suffer noticeably. The coarse material circulation ratio is reduced dramatically by this method and, in this manner, the overall need for energy in the milling circuit and the mechanical expenditure are reduced.

When wet grinding, liquid, expelled from the voids between the particles being ground, should be permitted to escape from the grinding chamber through at least one aperture of small cross section. The term wet grinding is used to define a mode of operation with which the material to be ground is contained in a liquid which usually is water. The amount of liquid at least must fill all the voids between particles of the consolidated material to be ground. In each of the mills listed above the material to be ground is stressed by compacting it due to the mutual approaching of two non-yielding surfaces. Wet grinding has the disadvantage, due to its principle, that a considerable amount of material to be ground is flushed out of the range of influence of those surfaces by the displaced liquid, thus being withdrawn from the stressing. This effect occurs also with dry grinding in the very fine range and especially so in the microfine range. The invention avoids this disadvantage by virtue of the fact that, in wet grinding, the stressing takes place in a grinding chamber which is defined all around, in other words closed, except for a few openings of small cross section to drain the liquid. Consequently only a minor proportion of the material to be ground can be flushed out. The grinding chamber is opened for loading with material to be ground, then closed prior to the stressing, and reopened for discharge of the material when the stressing is completed. It is convenient to use one pair of pistons or, if desired, a second pair of pistons for loading and unloading of the grinding chamber. A loading piston has a greater backward stroke to feed material to be ground from a feeding chute in front of its face end wall and convey it into the grinding chamber while partly sealing the feeding shaft. After a sufficient number of stressing strokes unto the material to be ground, the unloading piston is retracted until it opens the outlet channel or bore in which it is reciprocated into a discharge chute toward which the ground material having been stressed sufficiently is conveyed by the loading piston which for this purpose is advanced further than for stressing.

It was found that sufficiently great clearance between the pistons and the piston channels is sufficient to assure the draining of the liquid expelled while, at the same time, retaining the major portion of the particles to be comminuted of the material to be ground.

Studies in a laboratory installation provided the comminution results below.

Fine comminution of quartz having a maximum particle size $x_{max}$ of 2000 μm down to a fineness with which the maximum particle size is 80 μm: specific energy consumption 7 to 10 kWh/t. For comparison: a ball mill consumes from 20 to 40 kWh/t.

Very fine comminution of quartz having a maximum particle size $x_{max}$ of 2000 μm down to a fineness with which the maximum particle size is 20 μm: specific energy consumption from 20 to 30 kWh/t. For comparison: a ball mill consumes from 70 to 100 kWh/t.

Microfine comminution of quartz having a maximum particle size $x_{max}$ of 2000 μm down to a fineness with which the maximum particle size is 5 μm: specific energy consumption from 100 to 150 kWh/t. For comparison: an agitator mill consumes from 300 to 500 kWh/t.

Microfine comminution to below 2 μm:

limestone at $x_{max}$=40 μm: approximately 120 kWh/t quartz at $x_{max}$=30 μm: approximately 220 kWh/t zirconium at $x_{max}$=30 μm: approximately 240 kWh/t corundum at $x_{max}$=50 μm: approximately 440 kWh/t.

BRIEF DESCRIPTION OF THE DRAWINGS

The invention will be described further, by way of example, with reference to the accompanying drawings, in which:

FIGS. 1*a* and 1*b* show a multi-piston mill in longitudinal section and cross section, respectively;

DETAILED DESCRIPTION

Figure 2B:
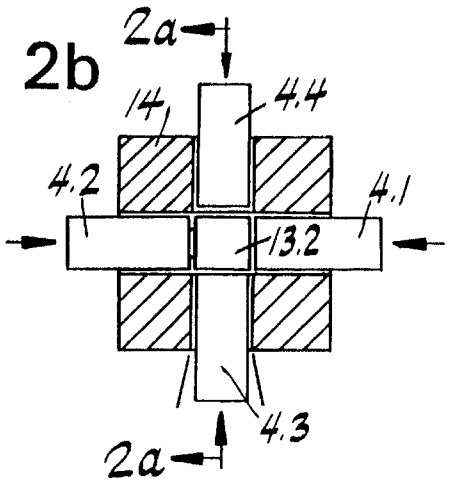
FIGS. 2*a* and 2*b* are a first vertical longitudinal and a second vertical longitudinal section rotated through 90° with respect to the first one showing a six-piston mill which includes a grinding chamber closed all around, especially for wet grinding.

In the case of the multi-piston mill 7 illustrated in FIG. 1 material to be ground 1 is fed to the mill from the top through a feed funnel 2 and then moves as bulk material from top to bottom in a cylindrical grinding chamber 3 of a milling block from which it is discharged at the bottom by a discharge worm 5. It leaves the mill as a ground product 6 having been stressed several times. Grinding pistons 4 are combined in groups of four each in a plane and aligned crosswise in pairs. Several groups of pistons are arranged in parallel planes one on top of the other. The respective opposed pistons each are actuated at the same time, stressing the material to be ground, which is present as a bed of bulk material, from opposite directions. The two pairs of pistons in one plane became active one after the other. The end faces of the pistons are hard surfaces between which effective stressing of the material to be ground in a bed of particles can take place.

Figure 2A:
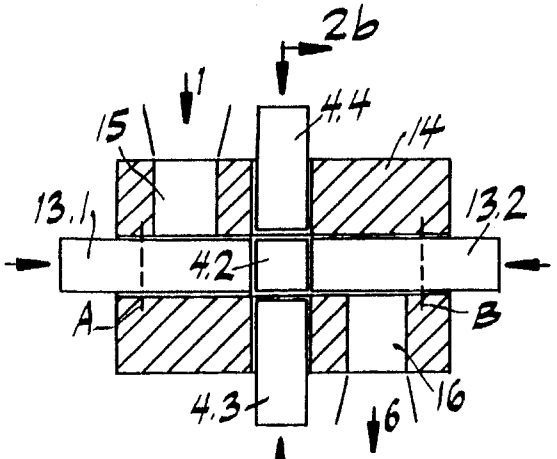

FIGS. 2*a* and 2*b* snow a six-piston mill for use above all in wet grinding, comprising a grinding chamber 3 which is closed all around. All the pistons 4.1 to 4.4 as well as 13.1 and 13.2 are driven in per se known manner by hydraulic power cylinders located outside of the milling block 14 and, therefore, not shown in the drawing. In principle, also mechanical drive means can be used instead of the hydraulic drives. For reasons of clarity, the seals between pistons and the bores or channels in the milling block 14 are not shown either. Pistons 4.1 to 4.4 and 13.1 and 13.2 move freely in piston channels of the milling block 14. Expelled liquid can flow through the gap between the pistons and the piston bores or channel walls. To load the central grinding chamber 3, piston 13.1 which serves as loading piston moves back to plane A marked by a discontinuous line. The material to be ground slides through a feed chute 15 into the channel of the loading piston 13.1 and is then conveyed by the latter into the grinding chamber 3. A piston 13.2 serving as unloading piston is disposed coaxially and diametrically opposite. It is located in the position shown and defines the grinding chamber 3 at its side. The pistons 4.1 to 4.4 arranged in a vertical plane serve for stressing. Piston pair 4.1, 4.2 is disposed at right angles with respect to piston pair 4.3, 4.4. The piston pairs are advanced alternatingly into the grinding chamber 3, stressing the material to be ground several times in succession. For discharge of the material from the grinding chamber, the unloading piston 13.2 is moved back into the plane B marked by a discontinuous line in FIG. 2*a*, and the loading piston 13.1 pushes the ground product which has been stressed to a discharge chute 16 in the milling block 14. Thereafter the loading and unloading pistons are jointly moved back into the starting positions A.

Figure 3B:
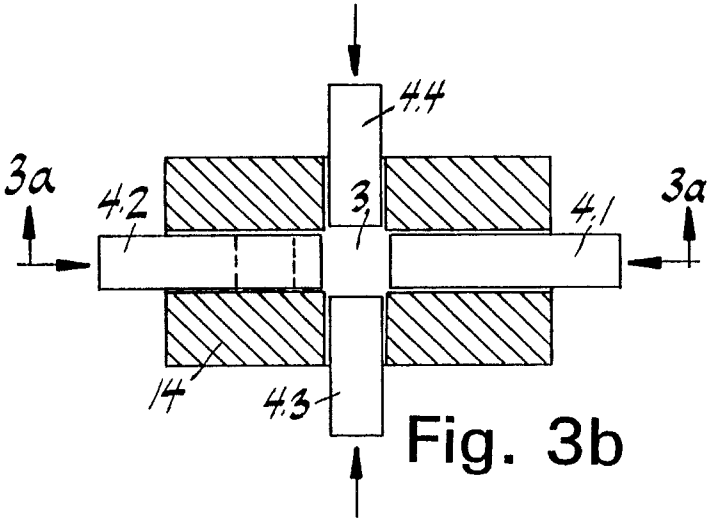
FIGS. 3*a* and 3*b* are a vertical longitudinal section and a horizontal cross section of a four-piston mill which includes a grinding chamber closed all around, especially for wet grinding.
Figure 3A:
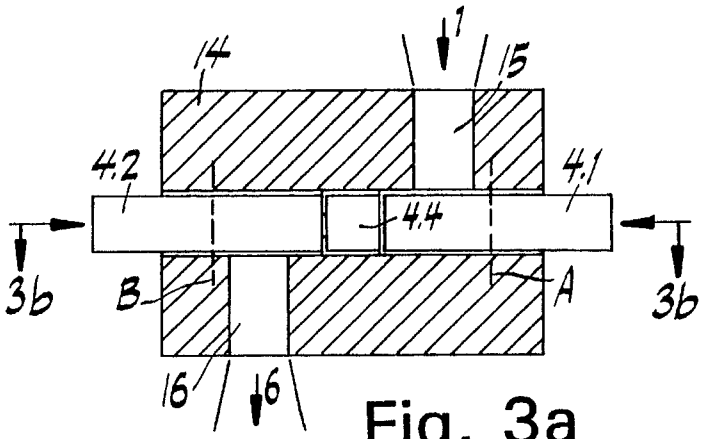

FIGS. 3*a* and 3*b* illustrate another modification which differs from the one according to FIGS. 2*a* and 2*b* in that the loading of the grinding chamber 3 from the feed chute 15 is taken care of by the grinding piston 4.1, while the discharge is effected by having grinding piston 4.2 move back into the plane marked by the discontinuous line B and having grinding piston 4.1 push the stressed ground product 6 to the discharge chute 16. This modification comprises only four pistons 4.1 to 4.4.

Figure 4A:
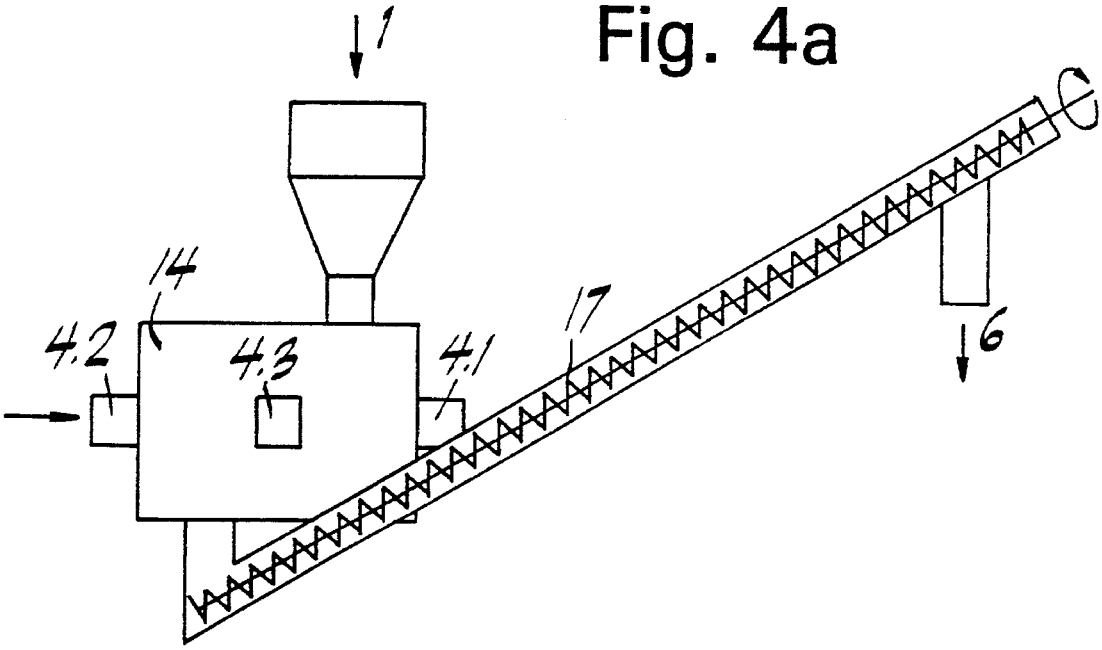
FIGS. 4*a* and 4*b* are views of a four-piston mill which includes a grinding chamber closed all around for wet grinding, designed for discharge of material by feed screw or star-type gate.
Figure 4B:
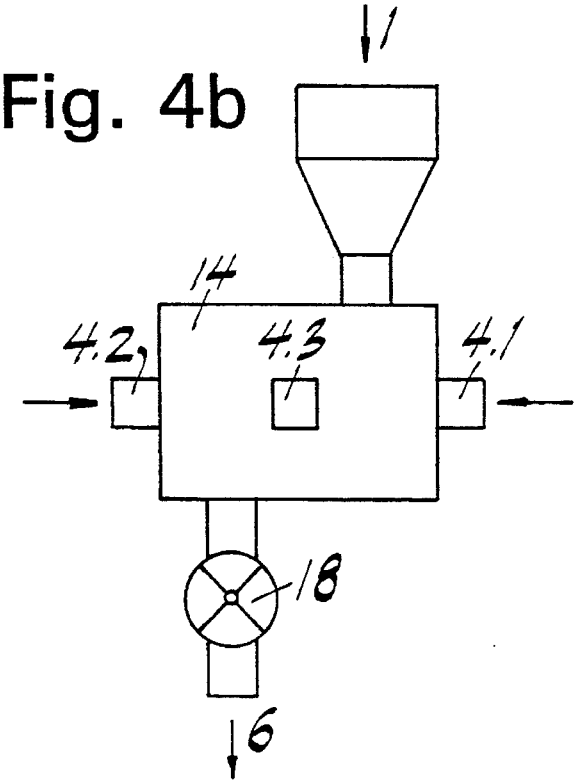

FIGS. 4*a* and 4*b* illustrate a four-piston mill for wet grinding which comprises two different kinds of discharge devices. In FIG. 4*a* the discharge of the stressed ground material 6 is realizes by a conveyor screw 17 in an upwardly inclined tube. In FIG. 4*b* this task is accomplished by a star-type gate 18.

Figure 5:
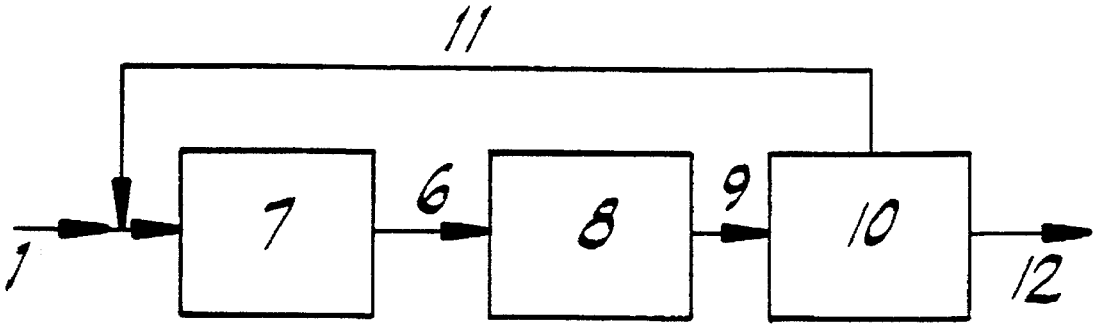
FIG. 5 shows a milling circuit including a multi-piston mill.

FIG. 5 presents a method diagram of a possible grinding circuit system. The material to be ground 1 is supplied to the mill 7 where it is comminuted. Upon stressing, the ground material 6 is conveyed into a disagglomerator 8 which separates or disintegrates the agglomerates that had formed. An impact or ball mill may be used as disagglomerator. The disagglomerated ground product 9 reaches a classifier 10 for separating coarse material 11 from fine material 12. The coarse material 11 is recirculated to the mill 7, while the fine material 12 is withdrawn from the circuit as the ground product.

We claim:

1. A method of comminution of brittle materials by compression between non-yielding surfaces to produce fine to microfine materials, comprising the steps of:

providing a grinding chamber with non-yielding surfaces into and out of which pistons with non-yielding surfaces are reciprocatable;

supplying material to be ground into said grinding chamber to form a bed of particles;

successively and in different directions subjecting the bed of particles to compression between said non-yielding surfaces of said pistons at a pressure of at least 50 MPa (500 kg/cm$^2$) by repeatedly reciprocating the pistons;

terminating the reciprocation of the pistons after a predetermined number of strokes;

discharging the material including any agglomerates that have formed during the compressing step from the grinding chamber;

disagglomerating the material discharged from the grinding chamber; and separating fine material from any coarse material in the product of said disagglomerating step by classification.

2. The method as claimed in claim 1, wherein for very fine comminution, the material to be ground is subjected to compression at a pressure of at least 150 MPa.

3. The method as claimed in claim 1, wherein for very fine comminution, the material to be ground is subjected to compression at a pressure of at least 250 MPa.

4. The method as claimed in claim 1, wherein any coarse material separated by said classification step, is recirculated to the grinding chamber for further grinding.

5. The method as claimed in claim 1, wherein successively subjecting the bed of particles to compression is effected in spaced apart planes and the directions of reciprocation of the pistons is arranged offset from 60° to 120° with respect to each other.

6. The method as claimed in claim 1, wherein air or liquid expelled from voids between the particles while the particles are being subjected to compression is permitted to escape through at least one small aperture.

7. A comminuting apparatus for fine to microfine comminution of brittle materials by compression between non-yielding surfaces, comprising:

at least one grinding chamber to be loaded and unloaded with batches of brittle material to be ground to form a bed of particles therein, said grinding chamber having hard non-yielding surfaces; and a plurality of grinding pistons having hard non-yielding surfaces adapted to be pushed forward into and retracted from the grinding chamber to subject the bed of particles to compression between said non-yielding surfaces of said pistons, said grinding chamber being closed to the outside, said grinding pistons being adapted to be reciprocated in succession and from different directions, to compress said bed of particles between said non-yielding hard surfaces of said pistons.

8. The apparatus as claimed in claim 7, wherein the grinding pistons are arranged in groups, the groups being arranged in spaced apart planes, and the pistons of a group being reciprocatable toward and away from each other.

9. The apparatus as claimed in claim 8, wherein a group consists of two opposedly arranged grinding pistons simultaneously reciprocatable towards and away from each other for compression of the bed of particles, the axes of said pistons in two adjacent planes are arranged offset by approximately 90° with respect to each other.

10. The apparatus as claimed in claim 8, wherein each group consists of two pairs of opposedly arranged grinding pistons simultaneously reciprocatable towards and away from each other for compression of the bed of particles, the axes of said pairs are arranged offset by an angle of approximately 60° to 120° with respect to each other, the two pairs of pistons being adapted to compress the bed of particles one after the other.

11. The apparatus as claimed in claim 8, wherein only one group of 4 pistons is provided.

12. The apparatus as claimed in claim 7, wherein the grinding chamber has at least one opening of small cross section permitting liquid expelled from voids between the particles while the particles are being subjected to compression to escape therefrom.

13. The apparatus as claimed in claim 7, wherein the grinding chamber is cylindrical having a cylindrical inner wall and the material to be ground is transported along said cylindrical grinding chamber, wherein bores are provided in the wall of said grinding chamber to receive said grinding pistons adapted to be pushed forward and retracted therein, and wherein a discharge device is provided at one end of the grinding chamber for discharging ground material from said chamber.

14. The apparatus as claimed in claim 7, further comprising at least one loading piston and at least one unloading piston, said loading and unloading pistons being retractable to such an extent that material to be ground may be fed into or discharged from the grinding chamber, respectively, through bores in which said loading and unloading pistons reciprocate.

15. The apparatus as claimed in claim 7, wherein said grinding pistons are arranged in a plane, said apparatus further comprising a loading piston and an unloading piston arranged in a plane perpendicular with respect to the plane in which the grinding pistons are arranged.

* * * * *